United States Patent [19]

Rhoads, Sr.

[11] 4,442,918

[45] Apr. 17, 1984

[54] EMERGENCY ESCAPE DEVICE

[75] Inventor: Gerald A. Rhoads, Sr., Yuma, Ariz.

[73] Assignees: X-Pert Well Service, Inc.; Gerald A. Rhoads, Jr., both of Hobbs, N. Mex.; a part interest

[21] Appl. No.: 504,584

[22] Filed: Jun. 15, 1983

[51] Int. Cl.[3] ..... A62B 1/02; A62B 1/12

[52] U.S. Cl. ..... 182/10; 182/192; 182/1[illegible]; 182/238

[58] Field of Search ..... 182/10, 192, 193, 191, 182/238, 233; 188/151 R

[56] References Cited

U.S. PATENT DOCUMENTS

| | | | |
|---|---|---|---|
| 293,322 | 2/1884 | Griswold | 182/10 |
| 1,849,725 | 3/1932 | Quick | 182/10 |
| 1,888,911 | 11/1932 | Graffenreid | 182/10 |
| 3,826,335 | 7/1974 | Allen | 182/10 |
| 3,880,254 | 4/1975 | Fitzgerald et al. | 182/2 |
| 4,050,542 | 9/1977 | Wilson | 182/10 |
| 4,056,167 | 11/1977 | Bonafos | 182/10 |
| 4,111,281 | 9/1978 | Jacobs | 182/10 |
| 4,122,917 | 10/1978 | Kendrick | 182/10 |
| 4,294,331 | 10/1981 | Reynoir | 182/10 |

OTHER PUBLICATIONS

One-page informational brochure regarding "Geronimo" Escape Device Manufactured by Taber Welding Company, 301 S. 11th Street, Perry, Oklahoma 73077.

*Primary Examiner*—R. P. Machado

*Attorney, Agent, or Firm*—Cahill, Sutton & Thomas

[57] ABSTRACT

An escape device for allowing an endangered person to be safely lowered from a drilling tower or other elevated structure includes an automatic brake which controls the descent of a trolley assembly downwardly along an escape cable extending from the elevated structure to a ground level anchor remote from the structure. The automatic brake includes a reel rotatably secured to the elevated structure and a brake cable wound about the reel and attached at one end to the trolley assembly. A fluid pump coupled to the reel causes the reel to rotate at a constant speed when the trolley assembly descends the escape cable. The effective diameter of the reel decreases as the brake cable is unwound therefrom, thereby slowing the rate of descent of the trolley assembly as it approaches the lower end of the escape cable. The escape device is adapted to be used with both the upper and lower stations of a derrick or similar elevated structure.

16 Claims, 15 Drawing Figures

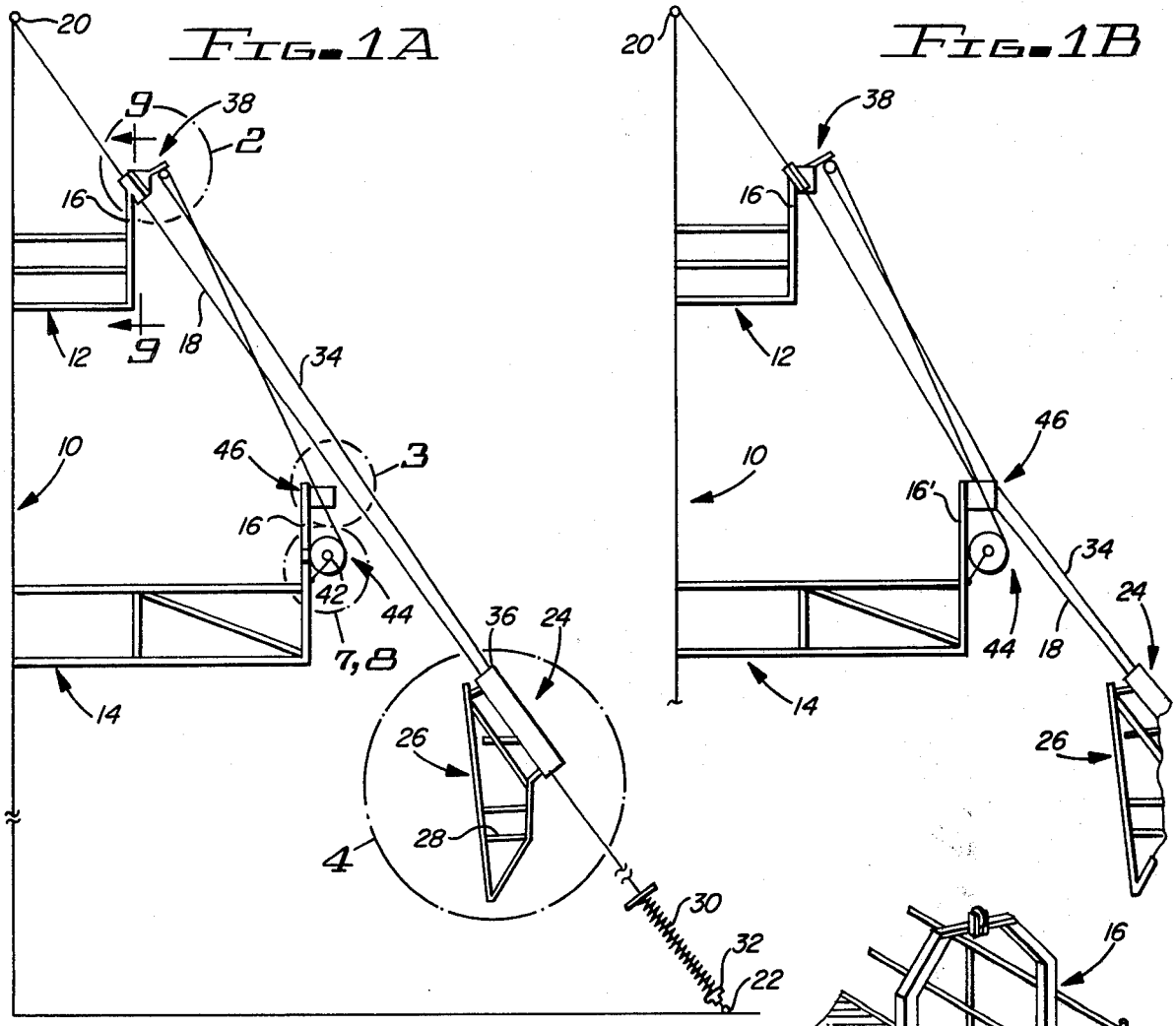
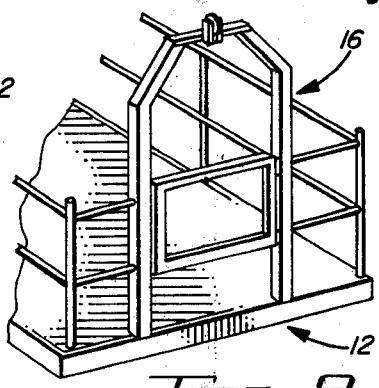
FIG. 9
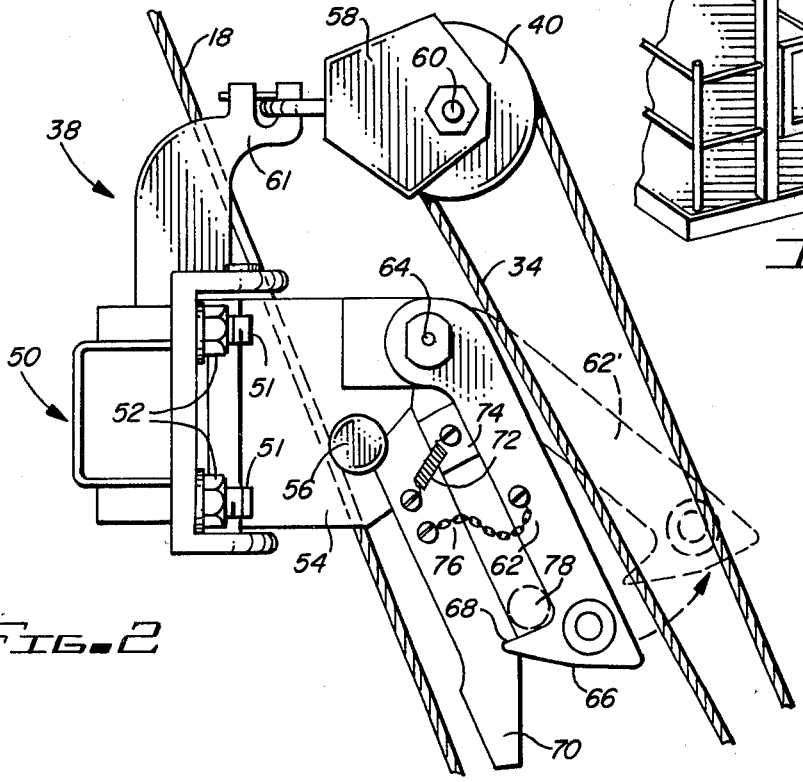
FIG. 2

EMERGENCY ESCAPE DEVICE

BACKGROUND OF THE INVENTION

1. Field of the Invention

The present invention relates generally to escape devices used to lower an endangered person from an elevated structure along an escape cable in the event of an emergency, and more particularly, to such an escape device incorporating an automatic brake which permits the endangered person to initially descend rapidly to escape the site of the emergency, while automatically slowing the rate of descent as the endangered person approaches the lower end of the escape cable.

2. Description of the Prior Art

When drilling wells and installing tubing within such wells, it is often necessary to station workers at one or more elevated stations within a derrick to perform certain various operations. In the event of a fire or other emergency, it is necessary to quickly evacuate such workers from the derrick.

Various types of escape devices adapted to lower endangered workers from elevated stations of a derrick, tower, or other elevated structure, are known in the art. One relatively simple escape device is sold under the trademark "GERONIMO" by Taber Welding Company of Perry, Okla., and consists of an L-shaped bar suspended from a box housing a pair of pulleys and equipped with a manual brake lever. The pulleys engage an escape cable extending between the elevated structure and a ground-based anchor. A person using this escape device seats himself upon the lower portion of the L-shaped bar while grabbing the upper portion of the bar with one hand and regulating his descent along the escape cable by operating the manual brake lever with his other hand. While generally serving its intended purpose, the "GERONIMO" escape device requires the endangered person to use both of his hands in order to safely descend from the elevated structure. Yet, following the occurrence of a fire or other emergency, workers stationed atop the elevated structure may sustain injuries which prevent such workers from using both of their hands to operate such an escape device.

U.S. Pat. No. 3,826,335 issued to Allen describes an apparatus for moving persons from atop a drilling rig or the like to the ground wherein a gondola is supported from an escape cable, and an automatic brake controls the descent of the gondola. A brake cable is coupled at one end to the gondola and is engaged about a set of sheaves associated with a counter weight that moves vertically upon rollers engaged within a vertical track. Vertical movement of the counter weight, and hence movement of the brake cable and gondola, is controlled by a hydraulic piston and cylinder and by an adjustable orifice. A manual brake is also incorporated into the gondola. However, the descent of the gondola along the escape cable is believed to be essentially linear. Moreover, the counterweight, sheaves, piston and cylinder, and other components of the braking system are relatively bulky, expensive, and somewhat difficult to install upon the derrick or other elevated structure. Further, the apparatus described by Allen is limited to use with a single elevated station, whereas the derrick or other elevated structure may include more than one elevated station from which a worker must be able to escape.

U.S. Pat. No. 4,056,167 issued to Bonafos discloses an emergency elevator for automatically controlling the descent of an endangered person from a derrick or other elevated structure. The emergency elevator includes a chamber suspended from a supporting cable for transporting an endangered person downwardly along the supporting cable. The descent of the chamber is automatically controlled by a brake cable connected to the chamber and extending from a winch-controlled device fixed to the derrick. The winch-controlled device is similar to a J.R.G. type commercially sold to brake vertical falls. However, the rate of descent of the chamber is again believed to be essentially linear. Moreover, the emergency elevator disclosed within the Bonafos patent may be used in conjunction with a single elevated station of the derrick or other elevated structure.

U.S. Pat. No. 3,880,254 discloses an escape boom for use with an off-shore drilling rig wherein a number of lifelines extend from different points on the rig to the remote head of the escape boom.

U.S Pat. No. 4,050,542 discloses a mobile rescue apparatus for rescuing individuals from a high-rise building. The rescue apparatus includes a telescoping chute, a pair of cable sections extending from the top of the chute to the bottom thereof, and a bag device for supporting the person to be rescued. The rate of descent of the bag device along the chute is controlled by varying the divergence of the pair of cable sections.

In the event of an emergency it is desirable that an escape device permit the initial descent of the endangered person to be relatively rapid in order to remove the endangered person from the site of the emergency. Of course, it is also desirable that the initially rapid rate of descent be decreased as the endangered person approaches the lower end of the escape cable to prevent injury to the endangered person due to impact with the ground at the end of the descent.

As mentioned above, the derrick or other elevated structure may include more than one elevated station from which it may be necessary to escape. For example, a derrick may include an upper station located at the rod basket and a lower station located at the tubing board. It is desirable that the escape device be adapted for use in conjunction with either of such elevated stations.

In view of the foregoing, it is an object of the present invention to provide an escape device which may be used to lower an endangered person from an elevated structure along an escape cable in the event of an emergency wherein the rate of descent of the escape device is automatically controlled to initially permit the endangered person to descend relatively rapidly from the elevated structure while automatically decreasing the rate of descent as the endangered person approaches the lower end of the escape cable.

It is another object of the present invention to provide such an escape device which may be easily adapted for use with two different elevated stations of a derrick or other elevated structure.

It is still another object of the present invention to provide such an escape device which is of relatively simple and compact construction and which may be easily installed upon a derrick, tower, or other elevated structure.

These and other objects of the present invention will become more apparent to those skilled in the art as the description of the present invention proceeds.

SUMMARY OF THE INVENTION

Briefly described, and in accordance with one embodiment thereof, the present invention relates to an escape device for allowing an endangered person to be lowered from an elevated structure in the event of an emergency, the escape device including an escape cable extending from the elevated structure to a remote anchor, a trolley assembly including a seat or chair for descending the escape cable by rolling downwardly therealong, and an automatic brake extending between the elevated structure and the trolley assembly for automatically regulating the descent of the seat along the escape cable. The automatic brake permits the initial rate of descent of the seat along the escape cable to be relatively rapid for removing the endangered person from the site of the emergency, while automatically causing the rate of descent of the seat to decrease as it approaches the lower end of the escape cable.

Within the preferred embodiment of the present invention, the automatic brake of the escape device includes a reel rotatably secured to the elevated structure and a brake cable secured at a first end to the trolley assembly and adapted to be wound about the reel when the trolley assembly is positioned adjacent the elevated structure. The reel is of sufficiently narrow width relative to the length of the brake cable for causing the brake cable to be repeatedly wound about itself. When the escape device is utilized, the brake cable is unwound from the reel as the trolley assembly descends the escape cable. The automatic brake includes a control mechanism which causes the reel to rotate at a substantially constant rotational speed as the brake cable is unwound therefrom. As the brake cable is unwound from the reel, the effective diameter of the brake cable windings wound about the reel continuously decreases; consequently, the length of the brake cable unwound from the reel for each rotation thereof continuously decreases as the brake cable is unwound therefrom. In this manner, the rate of descent of the trolley assembly steadily decreases as the trolley assembly approaches the lower end of the escape cable.

The aforementioned control mechanism which causes the reel to rotate at a substantially constant rotational speed is preferably a fluid pump having a rotatable drive shaft coupled to the axis of the reel for rotation therewith. The inlet of the fluid pump communicates with a fluid reservoir, and the outlet of the fluid pump communicates with a valve for regulating the outflow of fluid from the fluid pump, and hence, the rotational speed of the fluid pump drive shaft.

The escape device of the present invention includes a latch mechanism secured to the elevated structure for releasably engaging the trolley assembly in order to maintain the seat of the trolley assembly proximate to the elevated structure for access by an endangered person. The trolley assembly includes a release bar which engages the latch mechanism and which releases the latch mechanism for allowing the seat to descend the escape cable when the release bar is operated by the endangered person. The latch mechanism preferably includes a catch arm pivotally coupled at an upper end to the elevated structure and a lower end adapted to engage a latch pin extending from the trolley assembly. The trolley assembly further includes a camming arm operatively coupled to the release bar for camming the catch arm of the latch mechanism away from the latch pin when the release bar is operated.

In order to permit the use of the escape device of the present invention with first (upper) and second (lower) elevated stations of an elevated structure, the upper end of the escape cable is secured to the elevated structure proximate the upper elevated station. The aforementioned reel and fluid pump are secured to the elevated structure at the lower elevated station. The upper elevated station includes a first pulley over which the brake cable is guided. Thus the brake cable extends from the reel to the first pulley, and from the first pulley to the trolley assembly. The lower elevated station includes an engagement mechanism for releasably engaging the escape cable. When the escape device is being used to permit an escape from the upper station, then the escape cable is not secured to the engagement mechanism of the lower elevated station. Alternatively, if the escape device is to be used in conjunction with the lower elevated station, then the escape cable is secured by the engagement mechanism of the lower elevated station. Preferably, both the upper and lower station are each provided with a latch mechanism of the type described above for permitting the trolley assembly to be releasably engaged adjacent either the upper or lower elevated station.

The lower station may also be provided with a second pulley and a releasable retaining mechanism for selectively retaining the brake cable in engagement with the second pulley. The second pulley and associated retaining mechanism are used when the seat of the trolley assembly is to be positioned adjacent the lower elevated station, but not when the seat of the trolley assembly is to be positioned adjacent the upper elevated station. The above-mentioned engagement mechanism, second pulley, and associated retaining mechanism allow the escape device to be quickly and easily converted for use with either the upper or lower elevated stations.

BRIEF DESCRIPTION OF THE DRAWINGS

FIG. 1A illustrates an escape device constructed according to the teachings of the present invention and used in conjunction with the upper work station of a derrick or other elevated structure.

FIG. 1B depicts the escape device shown in FIG. 1A but used in conjunction with a lower work station.

FIG. 2 is an enlarged view of the portion of FIG. 1A encircled by dashed lines 2 and illustrating the components of the escape device which are secured to the upper station of the elevated structure.

FIG. 9 is a partial perspective view of an arbor of the type commonly provided at the edge of an elevated work station at which the seat of the escape device would normally be positioned.

DESCRIPTION OF THE PREFERRED EMBODIMENT

Figure 3A:
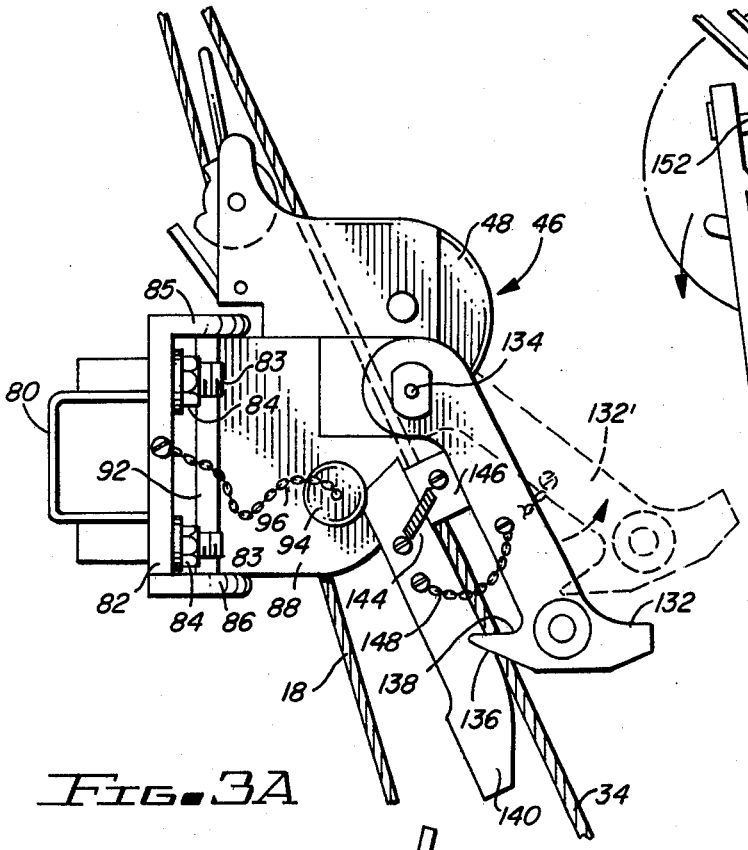
FIG. 3A is an enlarged front view of the portion of the escape device encircled by dashed lines 3 within FIG. 1A, and including a latch mechanism, an escape cable engagement mechanism, as well as a brake cable pulley and associated releasable retaining mechanism.

FIG. 1A generally shows an escape device constructed according to the teachings of the present invention and used in conjunction with a derrick 10 having an upper station 12 and a lower station 14. Upper station 12 might, for example, be located at the rod basket of derrick 10, while lower station 14 might be located at the tubing board of derrick 10. Both upper station 12 and lower station 14 include an arbor at the extreme right end thereof (with respect to FIG. 1A), the arbor 16 for upper station 12 being shown in FIG. 9.

An escape cable 18, preferably made of one-half inch diameter steel cable, is permanently secured at its upper end to the crown 20 of derrick 10, while the lower end of escape cable 18 is secured to a ground-based anchor 22.

Still referring to FIG. 1A, the escape device further includes a trolley assembly 24 including an escape chair 26 having a seat 28 upon which an endangered person may sit in order to descend from upper station 12 or lower station 14. Trolley assembly 24 engages escape cable 18 and suspends escape chair 26 therefrom for allowing escape chair 26 to descend escape cable 18 by rolling downwardly therealong.

As shown in FIG. 1A, a static brake 30 in the form of a heavy-duty spring is threaded about the lower end of escape cable 18 and secured thereto at its lower end by clamp 32. The upper end of static brake 30 engages the lower portion of trolley assembly 24 when escape chair 26 has fully descended escape cable 18 to cushion the landing of escape chair 26.

It will be recalled that the present invention includes an automatic brake for controlling the descent of escape chair 26. To this end, the escape device shown in FIG. 1A includes a brake cable 34 which is secured at a first end to trolley assembly 24 at a point designated by reference numeral 36. Brake cable 34 is preferably a one-quarter inch diameter steel cable. Brake cable 34 extends upwardly within FIG. 1A toward an upper station cable assembly 38 secured to the top of arbor 16. Referring briefly to FIG. 2, upper station cable assembly 38 includes a first brake cable pulley 40 around which brake cable 34 extends. After encircling pulley 40, brake cable 34 extends downwardly toward reel 42 of automatic brake assembly 44. As will be explained in greater detail below, brake cable 34 is unwound from reel 42 at a controlled rate as escape chair 26 descends escape cable 18 in order to initially descend rapidly from upper station 12 while steadily decreasing the rate descent as escape chair 26 approaches the lower end of escape cable 18.

FIG. 1B generally illustrates the manner in which the above-described escape device may be modified to permit an endangered person to escape from lower station 14 through arbor 16'. In this event, escape cable 18 is engaged by a lower station cable assembly 46 secured to the top of arbor 16'. Further details in regard to lower station cable assembly 46 are provided below. In addition, brake cable 34 engages a second brake cable pulley 48 (see FIG. 3B) within lower station cable assembly 46 before extending further upward toward first brake cable pulley 40 within upper station cable assembly 38. Both escape cable 18 and brake cable 34 may be quickly and conveniently disengaged from lower station cable assembly 46, in a manner described below, to permit escape chair 26 to again be used in conjunction with upper station 12.

Referring now to FIG. 2, upper station cable assembly 38 is shown in greater detail. Assembly 38 includes a mounting bracket 50 for extending around the top of arbor 16 (see FIG. 9) and securing assembly 38 thereto, as by bolts 51 and nuts 52. Cable assembly 38 includes a pair of parallel space-apart plates, one of which is designated by reference numeral 54, and the other of which is hidden from view. Escape cable 18 passes between parallel plates 54. A semi-permanent pin 56 extends perpendicularly through parallel plates 54 and prevents movement of escape cable 18 to the right (relative to FIG. 2). Escape cable 18 is permanently retained between parallel plates 54 by retention pin 56.

As mentioned above, upper station cable assembly 38 includes a first brake cable pulley 40. Pulley 40 is rotatably supported within pulley support member 58, and a grease zert 60 is provided for lubricating a bearing surface which supports pulley 40. Pulley support member 58 is in turn secured to a support arm 60 in a manner which allows pulley 40 to swivel about a horizontal plane.

It will be further recalled that the escape device of the present invention is provided with a latching mechanism for allowing the trolley assembly 24 and escape chair 26 to be releasably retained adjacent arbor 16 until such time as it is necessary for an endangered person to escape from upper station 12. With reference to FIG. 2, upper station cable assembly 38 incorporates such a latch mechanism including a catch arm or chair latch 62 having an upper end pivotally coupled to parallel plates 54 at a point designated by reference numeral 64. Pivotal coupling 64 may include a grease zert for allowing the bearing surfaces thereof to be lubicated periodically. The lower end of chair latch 62 includes a camming edge 66, as well as a latch pin hook 68. Also shown within FIG. 2 is one of a pair of parallel, spaced-apart trolley guide members 70.

Still referring to FIG. 2, a spring 72 extends between trolley guide member 70 and block 74 secured to chair latch 62. Spring 72 normally biases chair latch 62 to the solid line position shown within FIG. 2. However, upon applying a force against camming edge 66 of chair latch 62, chair latch 62 rotates toward the dashed line position 62'. Stop chain 75 serves to limit the extent to which chair latch 62 may be pivoted from the solid line position shown in FIG. 2.

Figure 5A:
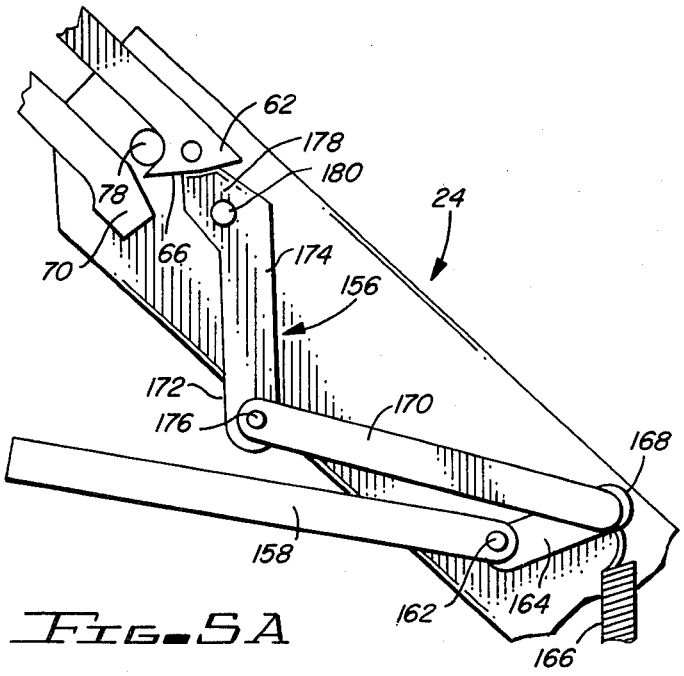
FIGS. 5A and 5B are enlarged views of the portion of the trolley assembly encircled by dashed lines 5A within FIG. 4.

With brief reference to FIG. 5A, the upper end of trolley assembly 24 includes a latch pin 78 which extends outwardly therefrom. As trolley assembly 24 and escape chair 26 attached thereto are retrieved toward upper station cable assembly 38, latch pin 78 engages camming edge 66 of chair latch 62 and pivots it counterclockwise (relative to FIG. 2) until latch pin 78 advances beyond latch pin hook 68; thereafter, return spring 72 causes chair latch 62 to return to the solid line position shown in FIG. 2 and thereby retains latch pin 78 and trolley assembly 24 adjacent upper station 12.

The upper portion of trolley assembly 24 passes between and is guided by the parallel spaced-apart trolley guide members 70. As is explained in greater detail below, trolley assembly 24 includes a chair release bar for causing chair latch 62 to pivot counterclockwise (with respect to FIG. 2) in order to allow chair 26 to descend escape cable 18 in the event of an emergency.

Figure 3B:
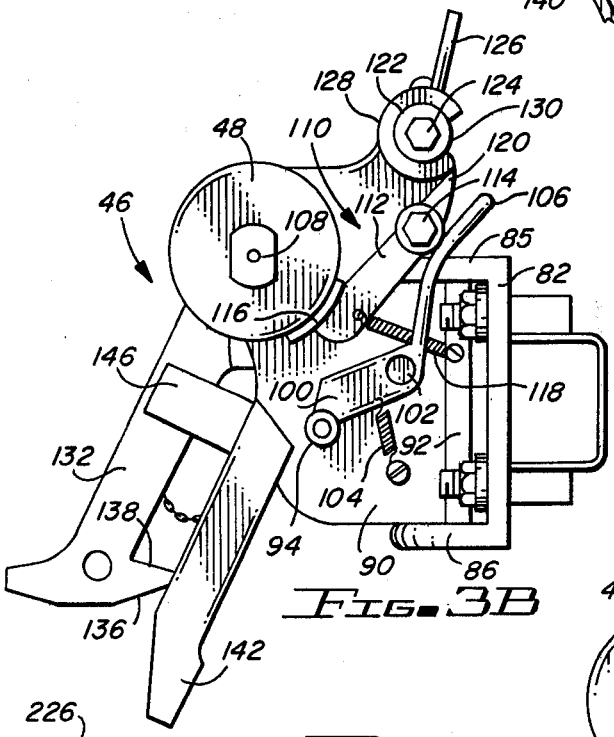
FIGS. 3B and 3C are rear views of the components shown in FIG. 3A.
Figure 3C:
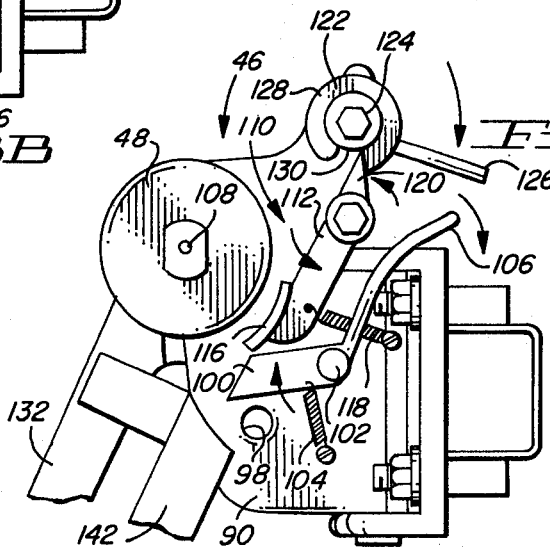

Reference is now made to FIGS. 3A, 3B, and 3C collectively wherein the lower station cable assembly 46 is shown in greater detail. Cable assembly 46 includes a mounting bracket 80 for securing cable assembly 46 to the top of arbor 16' of lower station 14 (see FIG. 1A and FIG. 9). Mounting bracket 80 is secured to a base plate 82 as by bolts 83 and nuts 84. Base plate 82 terminates in upper and lower, opposing horizontal flanges 85 and 86, respectively.

Lower station cable assembly 46 also includes a pair of vertically disposed, parallel spaced-apart plates 88 and 90 joined together at their left-most edges (with respect to FIG. 3A) by a vertically oriented cylinder 92 disposed between upper and lower flanges 85 and 86, respectively. A hinge pin (not shown) extends downwardly through flange 85, cylinder 92, and through lower flange 86 to form a pivotal coupling between parallel plates 88 and 90 and base plate 82 whereby parallel plates 88 and 90 can swivel within a horizontal plane relative to base plate 82.

Still referring to FIGS. 3A–3C, a removable escape cable retention pin 94 has a head portion shown in FIG. 3A attached by a chain 96 to base plate 82 to prevent retention pin 94 from being lost. As shown in FIG. 3C, a hole 98 is formed within plate 90 through which the shaft portion of retention pin 94 may be extended. FIG. 3B illustrates the shaft portion of retention pin 94 as it appears after being extended through hole 98.

In order to releasably retain retention pin 94 in engagement with parallel plates 88 and 90, a spring biased release mechanism 100 is secured to plate 90 by pivotal coupling 102. Spring 104 biases the lower portion of release mechanism 100 against the shaft portion of retention pin 94, thereby preventing it from being withdrawn. In the event that the user wishes to remove retention pin 94, and thereby disengage escape cable 18 from lower station cable assembly 46, the user merely rotates handle 106 of release mechanism 100 in a clockwise direction (with respect to FIG. 3C) for drawing release mechanism 100 away from retention pin 94 in order to permit the same to be removed from plates 88 and 90.

Still referring to FIGS. 3A–3C, lower station cable assembly 46 includes a brake cable pulley 48 which is adapted to engage brake cable 34 when the escape device is used in conjunction with lower station 14 of derrick 10 (see FIG. 1A). A grease zert 108 is provided for lubricating the bearing surfaces of pulley 48. A releasable retaining mechanism, designated generally by reference numeral 110, is provided for releasably retaining brake cable 34 in engagement with brake cable pulley 48 when the escape device is being used in conjunction with the lower station. Retaining means 110 includes a lever arm 112 pivotally coupled to lower station cable assembly 46 via a bolt 114. The lower end 116 of lever arm 112 includes a shoe for urging brake cable 34 into engagement with pulley 48. Lower end 116 of lever arm 112 is normally biased away from pulley 48 by a spring 118 extending between lower end 116 and vertical cylinder 92. The upper end 120 of lever arm 112 serves as a cam follower and is engaged by a rotatable cam 122. Cam 122 is rotatably mounted to lower station cable assembly 46 by bolt 124 and includes a handle 126 to facilitate the manual rotation of cam 122. Cam 122 is generally circular and includes a camming surface which extends about approximately a 270 degree arc for engaging upper end 120 of lever arm 112 and thereby causing lower end 116 to lie proximate to brake cable pulley 48, as shown in FIG. 3B. However, cam 122 further includes a reduced radius peripheral portion 130 extending about an arc of approximately 90 degrees, as shown in FIG. 3B. When handle 126 is rotated in a clockwise direction (with respect to FIGS. 3B and 3C), upper end 120 of lever arm 112 is engaged by reduced radius portion 130 rather than by camming surface 128, allowing lower end 116 of lever arm 112 to be biased away from pulley 48, as shown in FIG. 3C. The user may then disengage brake cable 34 from pulley 48 to allow the escape device to again be used with upper station 12 of derrick 10.

Like upper station cable assembly 38 as depicted in FIG. 2, lower station cable assembly 46 includes a latching mechanism for releasably maintaining escape chair 26 adjacent arbor 16' of lower station 14. The latch mechanism incorporated within lower station cable assembly 46 is identical to that described above in conjunction with upper station cable assembly 38. Thus, the latch mechanism shown in FIGS. 3A–3C includes a chair latch 132 pivotally coupled at its upper end to plate 88. Grease zert 134 is provided for allowing the bearing surfaces of the pivotal coupling between chair latch 132 and plate 88 to be lubricated. The lower end of chair latch 132 again includes a camming edge 136 and a latch pin hook 138 disposed thereabove for engaging latch pin 78 of trolley assembly 24 (see FIG. 5A). The latch mechanism associated with lower station cable assembly 46 further includes parallel, space-apart trolley guide members 140 and 142 for receiving and guiding the upper portion of trolley assembly 24. Spring 144 extends between trolley guide member 140 and block 146 secured to the rear side of chair latch 132 for biasing chair latch 132 to the solid line position shown in FIG. 3A. Block 146 rests against trolley guide member 140 and limits clockwise rotational movement of the lower end of chair latch 132 (relative to FIG. 3A). Stop chain 148 serves to limit counter-clockwise rotation of chair latch 132 (relative to FIG. 3A) beyond the dashed line position designated by reference numeral 132'. The operation of the chair latch mechanism associated with lower station cable assembly 46 is identical to that described above with regard to upper station cable assembly 38 and will therefore not be repeated here.

Figure 4:
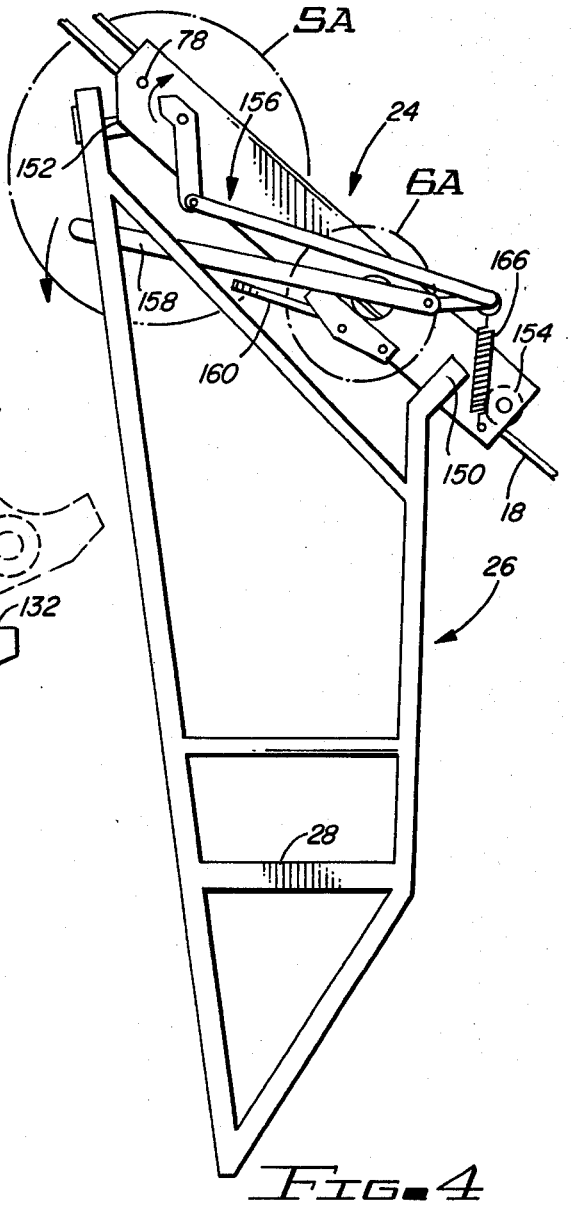
FIG. 4 is an enlargement of the trolley assembly and seat encircled by dashed lines 4 within FIG. 1A.

Escape chair 26 is shown in greater detail within FIG. 4 and generally consists of a tubular steel frame, including a seat 28, attached to trolley assembly 24 at attachment points designated by reference numerals 150 and 152. Trolley assembly 24 includes upper and lower pulleys for engaging escape cable 18 and supporting chair 26 therefrom. One such pulley is hidden from view in FIG. 4 and has an axis which corresponds with latch pin 78. The second pulley is also largely hidden from view within FIG. 4 and is designated by dashed circle 154. The aforementioned pulleys within trolley assembly 24 preferably utilize teflon bearings for long life and smooth operation. Grease zerts (not shown) may also be provided to allow such bearings to be periodically lubricated.

Still referring to FIG. 4, trolley assembly 24 includes a chair latch release mechanism generally designated by reference mumeral 156. Chair latch release mechanism 156 includes a chair release bar 158. In the event of an emergency requiring that a worker escape from his elevated station, the worker backs himself into escape chair 26, sits upon seat 28, and immediately pulls release bar 158 downward, as indicated by the arrow within FIG. 4. This operation releases latch pin 78 from the latch mechanism incorporated within both upper station cable assembly 38 and lower station cable assembly 46. The operation of chair latch release mechanism 156 is described in greater detail below.

Also shown in FIG. 4 is a manual emergency brake handle 160. If for any reason the automatic breaking system of the escape device fails, the user may control his descent manually by pulling downwardly upon emergency brake handle 160 to operate a manual brake in a manner described in greater detail below with regard to FIGS. 6A and 6B.

Figure 5B:
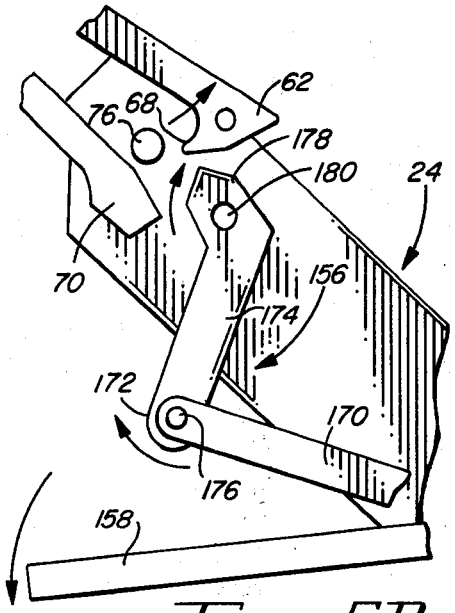

FIGS. 5A and 5B show the construction and operation of the chair latch release mechanism 156 in greater detail. With reference to FIG. 5A, chair release bar 158 is pivotally coupled to trolley assembly 24 at the point designated by reference numeral 162. A release bar extension member 164 is locked with release bar 158, as by welding, and rotates therewith. A spring 166 extends downwardly from the end 168 of release bar extension 164 opposite pivot point 162, the other end of spring 166 being secured to trolley assembly 24, as shown in FIG. 4. Therefore, release bar 158 is normally biased in an uppermost position as shown in FIG. 5A. A linkage 170 is pivotally coupled at one of its ends to end 168 of release bar extension member 164. The opposite end of linkage 170 is pivotally coupled to the lower end 172 of camming arm 174 at pivot point 176.

Assuming that trolley assembly 24 is initially positioned adjacent upper station 12 of derrick 10 (see FIG. 1), the chair latch 62 within upper station cable assembly 38 engages and retains latch pin 78. Spring 166 biases release bar 158 to its uppermost position, as shown in FIG. 5A, and the upper end 178 of camming arm 174 rests against camming edge 166 of chair latch 62. The upper end 178 of camming arm 174 is pivotally coupled to trolley assembly 24 at pivot point 180.

In the event of an emergency, the endangered person seats himself within escape chair 126 and pulls downwardly upon release bar 158, causing it to rotate counter-clockwise about pivot point 162 (relative to FIG. 5A). This rotational movement of release bar 158 causes linkage 170 to be shifted to the left (relative to FIG. 5A), thereby causing camming arm 174 to rotate in a clockwise direction about pivot point 180, as shown by the arrows within FIG. 5B. As camming arm 174 rotates about pivot point 180, upper end 178 nudges camming edge 66 of chair latch 62 upward, causing latch pin hook 68 to disengage from latch pin 78, as shown in FIG. 5B. Trolley assembly 24 and attached escape chair 26 are then free to roll downwardly under the force of gravity along escape cable 18.

Figure 6A:
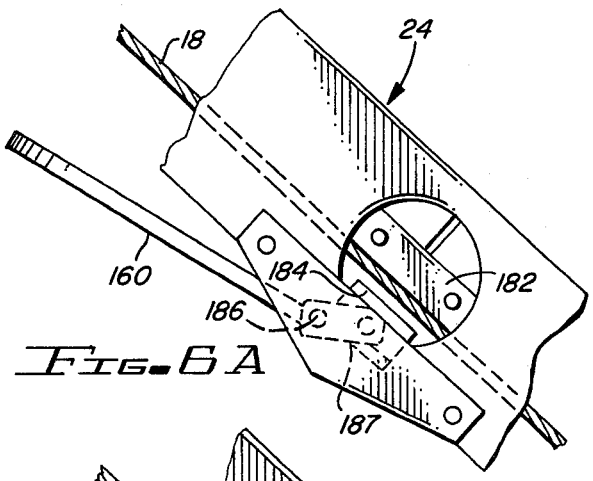
FIGS. 6A and 6B are enlarged views of a manual brake portion of the trolley assembly encircled by dashed lines 6A within FIG. 4.
Figure 6B:
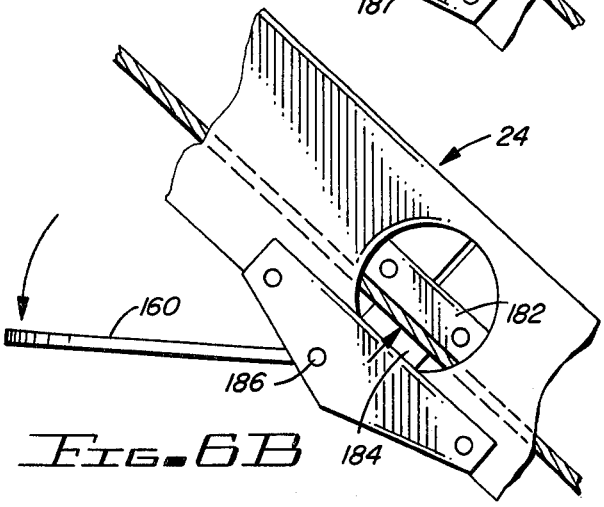

FIGS. 6A and 6B illustrate the construction and usage of a manual emergency brake incorporated within trolley assembly 24. As shown in FIG. 6A, a fixed upper brake block 182 is positioned such that the braking surface thereof lies just above and parallel to escape cable 18. A movable lower brake block 184 is disposed below and adjacent to escape cable 18 opposite brake block 182. Manual brake handle 160 is pivotally coupled to trolley assembly 24 by an axle 186, and a first end of lever arm 187 is rigidly secured to axle 186 for rotation therewith. The second end of lever arm 187 is pivotally coupled to movable brake block 184. Rotation of brake handle 160 in the counter-clockwise direction (relative to FIGS. 6A and 6B) rotates lever arm 187 counter-clockwise about axle 186 and thereby urges movable brake block 184 toward fixed brake block 182 in order to clamp escape cable 18 therebetween, as shown in FIG. 6B. A spring (not shown) returns manual brake handle 160 to the position shown in FIG. 6A when brake handle 160 is released by the user.

Figure 7:
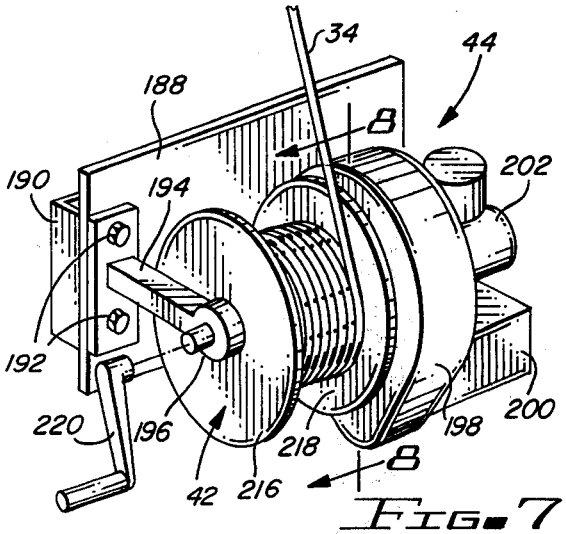
FIG. 7 is a perspective view of the brake cable reel, reduction gear housing, and fluid pump forming the automatic brake of the present invention.

It will be recalled that the escape device formed by the present invention includes an automatic braking system for controlling the descent of trolley assembly 24 and attached escape chair 26. FIG. 7 illustrates the preferred form of the automatic braking system 44. As shown in FIG. 7, components of the automatic braking system are mounted to the base plate 188. Base plate 188 is secured to a vertical side member of arbor 16' at lower station 14 of derrick 10, as by a mounting bracket 190 and bolts 192. As shown in FIG. 7, automatic braking system 44 includes a reel 42 mounted for rotation about a horizontal axis and secured to base plate 188, as by support arms 194. The axis 196 of reel 42 is coupled to a gear reduction unit enclosed within sprocket housing 198. The gear reduction system enclosed within sprocket housing 198 couples the axis 196 of reel 42 to a fluid pump 200 equipped with a fluid reservoir 202.

Figure 8:
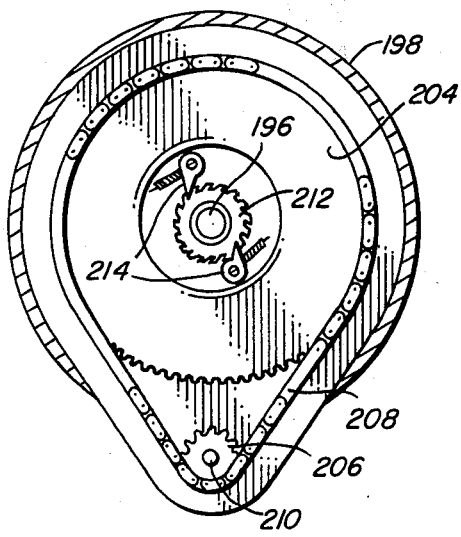
FIG. 8 is a sectional view taken through lines 8—8 of FIG. 7 and depicting the internal components of the gear reduction housing.

Referring to FIG. 8, the gear reduction mechanism includes a large sprocket 204 coupled to a smaller sprocket 206 by chain 208. Smaller sprocket 206 is locked to the drive shaft 210 of fluid pump 200. The axis 196 of reel 42 is coupled by a rachet gear 212 and a pair of pawls 214 to large sprocket 204. Rachet gear 212 and pawls 214 allow reel axis 196 to freewheel when brake cable 34 is rewound onto reel 42, while locking reel axis 196 to large sprocket 204 when brake cable 34 is unwound from reel 42. Large sprocket 204 and smaller sprocket 206 provide a 6:1 gear reduction whereby drive shaft 210 of fluid pump 200 is rotated 6 times for each rotation of reel 42.

As shown in FIG. 7, reel 42 is formed by a pair of spaced-apart discs 216 and 218 connected to one another by reel axis 196. The width of reel 42, i.e., the distance by which discs 216 and 218 are separated, is selected to be sufficiently narrow for causing brake cable 34 to be repeatedly wound about itself when the escape chair 26 is retrieved to its position adjacent either upper station 12 or lower station 14 of derrick 10. A detachable hand crank 220 may be used to rewind brake cable 34 onto reel 42 in order to retrieve escape chair 26; alternatively, an electric motor may be coupled to reel axis 196 in order to rewind brake cable 34 onto reel 42.

When the escape device is actually used by an endangered person, brake cable 24 is unwound from reel 42 in order to regulate the descent of escape chair 26. Fluid pump 200 maintains the rotational speed of reel 42 relatively constant as escape chair 26 descends along escape cable 18. As brake cable 34 is unwound from reel 42, the effective diameter of reel 42 from which additional lengths of brake cable 34 are dispensed continuously decreases, thereby dispensing shorter additional lengths of brake cable 34 for each rotation of reel 42. As the rotational speed of reel 42 is substantially constant, the rate of descent of escape chair 26 continuously decreases as the endangered person approaches the lower end of escape cable 18.

Figure 10:
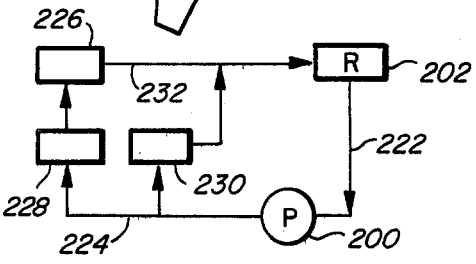
FIG. 10 is a schematic representation of the hydraulic components associated with the fluid pump shown in FIG. 7.

FIG. 10 is a schematic illustration of fluid pump 200, reservoir 202, and related components. Reservoir 202 is coupled to the suction inlet of pump 200 by fluid suction line 222. Fluid pump 200 includes an outlet coupled to fluid discharge line 224 for pumping fluid out of the fluid pump 200. A series of three valves, 226, 228 and 230 are used to regulate the outflow of fluid from the outlet of fluid pump 200. Valve 226 is a needle valve which may be adjusted with a screwdriver for regulating the rotational speed of reel 42, and hence, the initial rate of descent of escape chair 26.

Pressure relief valve 228 is interposed between the outlet of fluid pump 200 and the inlet to needle valve 226. Valve 228 is spring loaded to remain closed until a predetermined pressure is applied thereto. The weight of the escape chair alone is insufficient to create enough pressure to cause valve 228 to open; consequently, if the escape chair is inadvertently released without a passenger, fluid pump 200 resists the tendency of reel 42 to unwind. However, the additional weight of an endangered person within escape chair 26 causes fluid pump 200 to exceed the predetermined pressure needed to open pressure relief valve 228, and needle valve 226 thereafter regulates the outflow of fluid from fluid pump 200. The outlet of needle valve 226 is coupled by fluid return line 232 to fluid reservoir 202. When the escape chair reaches the lower end of escape cable 18, and the torque applied to fluid pump 200 is reduced, pressure relief valve 228 is again biased closed, resulting in the braking of reel 42 to prevent additonal amounts of brake cable 34 from being unwound therefrom.

Valve 230 is an auxilliary cable release valve or bypass valve which may be opened when desired by the user to bypass the fluid pump outlet directly to fluid reservoir 202 and thereby allow the escape chair to descend with little or no braking action.

Those skilled in the art will now appreciate that an escape device for allowing an endangered person to be safely lowered from a derrick or other elevated struoture has been described wherein an automatic braking system initially allows the descent of the escape chair along the escape cable to be relatively rapid while continuously decreasing the rate of descent of the escape chair as it approaches the lower end of the escape cable. Those skilled in the art will also appreciate that the upper station cable assembly and lower station cable assembly described above permit the escape device to be readily converted for use with either the upper or lower station of a derrick or other elevated structure. The described escape device is of simple and compact construction and easily mounts to the arbors of a derrick or other frame members of an elevated structure. While the present invention has been described with reference to a preferred embodiment thereof, the description is for illustrative purposes only and is not to be construed as limiting the scope of the invention. Various modifications and changes may be made by those skilled in the art without departing from the true spirit and scope of the invention as defined by the appended claims.

We claim:

1. An escape device for allowing an endangered person to be lowered from an elevated structure in the event of an emergency, the escape device comprising in combination;

a. an escape cable having an upper end secured to the elevated structure and a lower end secured to an anchor remote from the elevated structure, said escape cable extending at an angle to the vertical;

b. a trolley assembly including a seat for supporting the endangered person to be lowered from the elevated structure, said trolley assembly also including at least one pulley for engaging said escape cable and suspending said seat therefrom for allowing said seat to descend the escape cable by rolling downwardly therealong;

c. braking means extending between the elevated structure of said trolley assembly for automatically regulating the descent of said seat along said escape cable, said braking means permitting the initial rate of descent of said seat along said escape cable to be relatively rapid for removing the endangered person from the site of the emergency and automatically causing the rate of descent of said seat to decrease as said seat approaches the lower end of said escape cable.

2. An escape device as recited by claim 1 wherein said braking means includes:

a. a reel rotatably secured to the elevated structure;

b. a brake cable secured at a first end to said trolley assembly and adapted to be wound about said reel prior to the existence of an emergency and adapted to be unwound from said reel as said seat descends from said escape cable;

c. control means for causing said reel to rotate at a substantially constant speed as said brake cable is unwound from said reel;

d. said reel being of sufficiently narrow width for causing said brake cable to be wound upon itself whereby the effective diameter of said reel is decreased as said brake cable is unwound therefrom.

3. An escape device as recited by claim 2 wherein said control means includes:

a. a fluid reservoir;

b. a fluid pump having an inlet for receiving fluid from the fluid reservoir and an outlet for pumping fluid out of the fluid pump, said fluid pump having a rotatable drive shaft for operating the fluid pump;

c. valve means for regulating the outflow of fluid from the outlet of said fluid pump; and d. coupling means for coupling said drive shaft of said fluid pump to said reel for rotating said drive shaft as said brake cable is unwound from said reel.

4. An escape device as recited by claim 3 wherein said control means includes a conduit for coupling said valve means to said fluid reservoir for returning fluid expelled from said fluid pump outlet to said fluid reservoir.

5. An escape device as recited by claim 3 wherein said coupling means includes reduction gears for causing the drive shaft of said fluid pump to rotate a plurality of rotations for each rotation of said reel.

6. An escape device as recited by claim 1 wherein said elevated structure includes latch means for releasably engaging said trolley assembly to maintain said seat proximate to the elevated structure, and wherein said trolley assembly includes a release bar engaged with said latch means and operated by the endangered person for releasing said latch means and allowing the seat to descend said escape cable.

7. An escape device as recited by claim 6 wherein:

a. said trolley assembly includes a latch pin extending therefrom;

b. said latch means includes a catch arm having an upper end pivotally coupled to the elevated structure and a lower adapted to engage said latch pin; and c. said trolley assembly further including a camming arm operatively coupled to said release bar for camming said catch arm away from said latch pin when said release bar is operated by the endangered person.

8. An escape device as recited by claim 2 further including means for rewinding said brake cable onto said reel to retrieve said seat back to the elevated structure after said brake cable has been unwound from said reel due to the descent of said seat along said escape cable.

9. An escape device as recited by claim 2 wherein said elevated structure includes first and second elevated stations from which an endangered person may have to excape, the first elevated station being above the second elevated station, and wherein:

a. the upper end of said escape cable is secured to the first elevated station;

b. said reel and said control means are secured to the second elevated station;

c. said first elevated station includes a first pulley over which said brake cable is guided intermediate said reel and said trolley assembly; and d. the second elevated station includes engaging means for releasably engaging said escape cable to permit said escape device to be used alternatively with the first elevated station when said escape cable is not engaged by said engaging means, or with the second elevated station when said escape cable is engaged by said engaging means.

10. An escape devide as recited by claim 9 wherein the second elevated station further includes a second pulley and a releasable retaining means for releasably retaining said brake cable in engagement with said second pulley, said releasable retaining means retaining said brake cable in engagement with said second pulley when said escape device is used in conjunction with the second elevated station.

11. An escape device as recited by claim 9 wherein the first and second elevated stations include first and second latch means, respectively, for releasably engaging said trolley assembly to maintain said seat proximate to the first and second elevated stations, respectively, and wherein said trolley assembly includes a release bar adapted to be engaged with said first and said second latch means and operated by the endangered person for releasing said first and said second latch means and allowing said seat to descend said escape cable.

12. An escape device as recited by claim 11 wherein said trolley assembly includes a latch pin extending therefrom and wherein said first and second latch means each include a catch arm having an upper end pivotally coupled to the elevated structure and a lower end adapted to engage said latch pin, said trolley assembly further including a camming arm operatively coupled to said release bar for camming said catch arm away from said latch pin when said release bar is operated by the endangered person.

13. An escape device for regulating the descent of a person from an elevated point to a less elevated point of safety in the event of an emergency, said escape device comprising in combination:

(a) an escape chair for supporting an endangered person;

(b) means for releasably retaining said escape chair adjacent said elevated point until it is necessary for an endangered person to escape from the elevated point;

(c) a reel rotatably secured to the elevated point;

(d) a brake having a first end coupled to said escape chair and adapted to be wound about said reel prior to the existence of an emergency and adapted to be unwound from said reel as said escape chair descends from the elevated point;

(e) control means for causing said reel to rotate at a substantially constant speed as said brake cable is unwound from said reel; and (f) said reel being of sufficiently narrow width for causing said brake cable to be wound upon itself, the effective diameter of said reel being decreased as said brake cable is unwound therefrom for automatically causing the rate of descent of said escape chair to decrease as said escape chair approaches the less elevated point of safety.

14. An escape device as recited by claim 13 wherein said control means includes:

(a) a fluid reservoir;

(b) a fluid pump having an inlet for receiving fluid from the fluid reservoir and an outlet for pumping fluid out of the fluid pump, said fluid pump having a rotatable drive shaft for operating the fluid pump;

(c) valve means for regulating the outflow of fluid from the outlet of said fluid pump; and (d) coupling means for coupling said drive shaft of said fluid pump to said reel for rotating said drive shaft as said brake cable is unwound from said reel.

15. An escape device as recited by claim 14 wherein said control means includes a conduit for coupling said valve means to said fluid reservoir for returning fluid expelled from said fluid pump outlet to said fluid reservoir.

16. An escape device as recited by claim 14 wherein said coupling means includes reduction gears for causing the drive shaft of said fluid pump to rotate a plurality of rotations for each rotation of said reel.

* * * * *

UNITED STATES PATENT AND TRADEMARK OFFICE

CERTIFICATE OF CORRECTION

PATENT NO. : 4,442,918

DATED : April 17, 1984

INVENTOR(S) : Gerald A. Rhoads, Sr.

It is certified that error appears in the above-identified patent and that said Letters Patent are hereby corrected as shown below:

Column 14, line 18, following "brake", insert -- cable --.

Signed and Sealed this

*Twelfth* Day of *February 1985*

[SEAL]

*Attest:*

DONALD J. QUIGG

*Attesting Officer*

*Acting Commissioner of Patents and Trademarks*